US005586525A

United States Patent [19]

Masse

[11] Patent Number: 5,586,525

[45] Date of Patent: Dec. 24, 1996

[54] AIR/FUEL MIXTURE SUPPLY DEVICE FOR A TWO-STROKE INTERNAL-COMBUSTION ENGINE

[76] Inventor: Jean M. Masse, 60, rue Saint-Léger F-78100, Saint-Germain-en-Laye, France

[21] Appl. No.: 583,043

[22] PCT Filed: Aug. 2, 1994

[86] PCT No.: PCT/FR94/00972

§ 371 Date: Jan. 17, 1996

§ 102(e) Date: Jan. 17, 1996

[87] PCT Pub. No.: WO95/04212

PCT Pub. Date: Feb. 9, 1995

[30] Foreign Application Priority Data

Aug. 3, 1993 [FR] France ..... 93 09556

[51] Int. Cl.[6] ..... F02B 25/20

[52] U.S. Cl. ..... 123/73 B; 123/73 PP; 123/65 V

[58] Field of Search ..... 123/73 B, 73 C, 123/73 PP, 65 V, 65 P

[56] References Cited

U.S. PATENT DOCUMENTS

| | | | |
|---|---|---|---|
| 1,265,891 | 5/1918 | Ellis | 123/73 B |
| 2,113,979 | 4/1938 | Bokemuller | 123/65 V |
| 2,115,525 | 4/1938 | Hocke et al. | 123/65 V |
| 2,153,805 | 4/1939 | Kammer | 123/65 V |
| 2,214,047 | 9/1940 | Dorwin et al. | 123/65 V |
| 2,401,677 | 6/1946 | Yingling | 123/65 V |
| 2,473,164 | 6/1949 | McCoy | 123/65 V |
| 2,474,879 | 7/1949 | Winfield | 123/65 V |
| 3,190,271 | 6/1965 | Gudmundsen | 123/73 B |
| 4,779,581 | 10/1988 | Maier | 123/73 B |
| 4,995,354 | 2/1991 | Morikawa | 123/65 V |
| 5,237,966 | 8/1993 | Katoh et al. | 123/73 B |
| 5,315,962 | 5/1994 | Renault et al. | 123/65 V |
| 5,503,119 | 4/1996 | Glover | 123/73 B |

FOREIGN PATENT DOCUMENTS

| | | | |
|---|---|---|---|
| 0460820 | 12/1991 | European Pat. Off. | 123/65 V |
| 666717 | 11/1938 | Germany . | |
| 959596 | 7/1957 | Germany . | |
| 62-35019 | 2/1987 | Japan | 123/65 P |
| 3-78526 | 4/1991 | Japan | 123/73 PP |
| WO910214 | 2/1991 | WIPO . | |

OTHER PUBLICATIONS

International Search Report.

*Primary Examiner*—David A. Okonsky
*Attorney, Agent, or Firm*—Beveridge, DeGrandi, Weilacher & Young, LLP

[57] ABSTRACT

Air/fuel mixture supply device for a two-stroke internal-combustion engine, of the type with scavenging by compressed air in the casing, comprising at least one cylinder, a piston capable of reciprocating motion in the cylinder, and a scavenging-air compression casing, the cylinder comprising at least one exhaust port, at least one transfer port and a port for introduction of an air/fuel mixture.

A rotary closure member (19) driven in synchronism with the rotation of the engine is associated with the port (16) for introduction of the air/fuel mixture into the combustion chamber, this closure member being placed in an air reservoir (14) fed with air under a pressure greater than the pressure in the combustion chamber (10) after opening of the exhaust port (11).

9 Claims, 1 Drawing Sheet

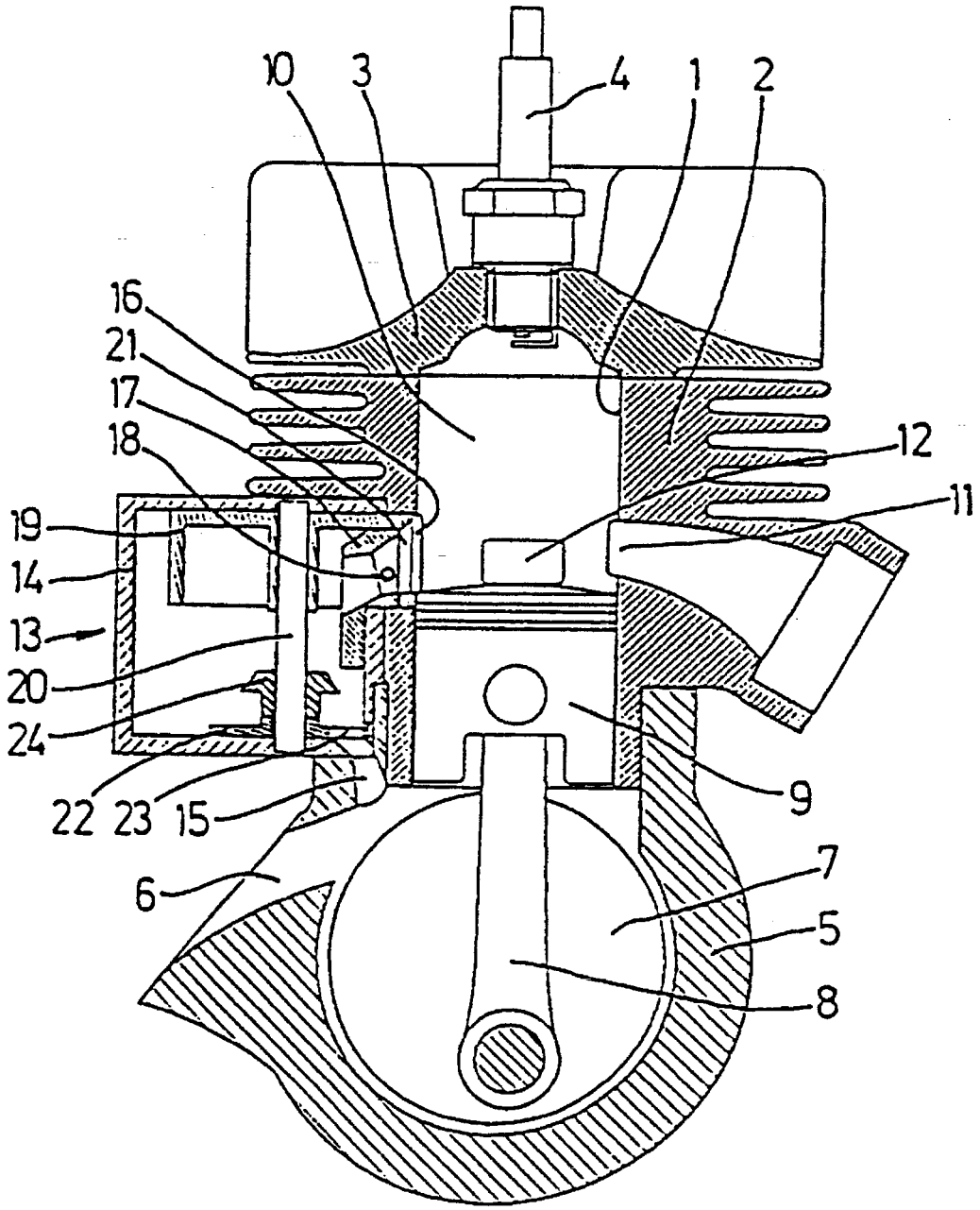
10
3
4
1
2
16
21
17
18
12
11
19
14
13
20
24
22
23
15
9
6
7
5
8

AIR/FUEL MIXTURE SUPPLY DEVICE FOR A TWO-STROKE INTERNAL-COMBUSTION ENGINE

The present invention relates to an air/fuel mixture supply device for a two-stroke internal-combustion engine, of the type with scavenging by compressed air in the casing, comprising at least one cylinder, a piston capable of reciprocating motion in the said cylinder for defining a combustion chamber and a scavenging-air compression casing provided with an air inlet orifice, the cylinder comprising at least one exhaust port, at least one transfer port communicating via a transfer duct with the casing, and a port for introduction of an air/fuel mixture into the combustion chamber, towards the end of the scavenging.

Internal-combustion engines operating with a two-stroke cycle have proved to have relatively high consumption and to lead to a relatively high degree of pollution. This two-fold problem is due to the scavenging of the combustion chamber, which scavenging is carried out using an air/fuel mixture and, in order to be efficient with a view to producing correct filling of the combustion chamber with air/fuel mixture and removing the burnt gases from the combustion chamber to the greatest possible extent, leads to direct passage of a part of the air/fuel mixture via the exhaust port, that is to say exhausting of unburnt gases.

This is the reason why it has already been proposed to produce scavenging of the combustion chamber by pure air rather than by an air/fuel mixture, the fuel being introduced into the combustion chamber only towards the end of the scavenging. For this purpose, it is possible to inject the fuel either directly into the combustion chamber (see Patent Application FR-2,582,349), or indirectly (Patent Application FR-2,609,504), or else to introduce it pneumatically (Patent Application FR-2,496,757). In order to introduce the fuel by injection, it is necessary to have a relatively high injection pressure and the injectors used are often electronically controlled for reasons of adjustment flexibility. On the other hand, pneumatic fuel introduction systems are produced by a valve controlled for example electronically or by a cam as a function of rotation of the engine, which limits the working speed of use because of risks of excessive opening of the valve or the activation time of the electronic control.

All these known solutions reduce the intrinsic advantages of two-stroke engines, namely relatively simple design and low cost price, which advantages are of particular interest for small engines used, for example, on two-wheeled vehicles.

The present invention aims to eliminate or at least reduce to a large degree the drawbacks of the solutions already proposed with a view to decreasing the consumption and the pollution of two-stroke engines.

The subject of the invention is an air/fuel mixture supply device for a two-stroke internal-combustion engine, of the type with scavenging by compressed air in the casing, this engine comprising at least one cylinder, a piston capable of reciprocating motion in the cylinder for defining a combustion chamber and a scavenging-air compression casing provided with an air inlet orifice. The cylinder comprises at least one exhaust port, at least one transfer port communicating via a transfer duct with the casing, and a port for introduction of an air/fuel mixture into the combustion chamber, towards the end of the scavenging. According to the invention, a rotary closure member driven in synchronism with the rotation of the engine is associated with the port for introduction of the air/fuel mixture into the combustion chamber.

Controlling the air/fuel mixture introduction port by a rotary closure member makes it possible to obviate, in a particularly simple manner, all the limitations, especially in working speed, to which known systems for injection or pneumatic introduction of fuel on two-stroke internal-combustion engines are subjected.

The supply device according to the invention preferably comprises an air reservoir supplied with air under a pressure greater than the pressure prevailing in the combustion chamber after opening of the exhaust port, a venturi placed between the said reservoir and the rotary closure member and a fuel feed coming from a constant-level tank and emerging in the divergent cone of the said venturi.

In this case, the rotary closure member is preferably placed inside the said reservoir.

The rotary closure member may preferably be a cylindrical slide valve closure member whose axis is parallel to the axis of the cylinder and which includes in its cylindrical wall a window controlling the communication of the reservoir via the introduction port with the combustion chamber.

The air reservoir may be supplied with pressurized air by a system external to the engine, or else by a system internal to the engine. In the latter case, the reservoir is advantageously supplied with air from the casing via a conduit which is also controlled by a turning closure member driven in synchronism with the rotation of the engine.

The upper edge of the port for introduction of the air/fuel mixture into the combustion chamber may lie at the same level as the upper edge of the exhaust port but, according to a preferred embodiment, the upper edge of the introduction port lies at a level closer to the cylinder head than the upper edge of the exhaust port, so that, when the piston is rising, the combustion chamber still communicates with the air reservoir and the increase in pressure in the combustion chamber leads to an increase of the air pressure in the reservoir with a view to introducing the air/fuel mixture during the following cycle.

The air/fuel jet of the air/fuel mixture supply device is preferably directed towards the cylinder head so that the said jet does not meet the exhaust port.

Referring to the single FIGURE of the attached drawing, a description will be given hereinbelow in more detail of an illustrative, non-limiting embodiment of a device according to the invention.

The engine as illustrated by the drawing is an internal-combustion engine operating with a two-stroke cycle, of the type with scavenging by compressed air in the casing. The drawing shows a cylinder 1 defined in a cylinder block 2 surmounted by a cylinder head 3 carrying a spark plug 4. The cylinder block 2 is attached on a casing 5 provided with an air inlet opening 6 and a valve, not shown. A crankshaft 7 rotates in the casing 5, which crankshaft is coupled by a rod 8 to a piston 9 which is capable of reciprocating motion in the cylinder 1 and it defines a combustion chamber 10 in the latter with the cylinder head 3.

The cylinder i furthermore includes an exhaust port 11 as well as a transfer port 12 communicating via a transfer duct, not shown, with the casing 5, the two ports 11 and 12 being arranged in the cylinder 1 so as to emerge in the combustion chamber 10 at a height such that they are completely uncovered only when the piston 9 is at bottom dead centre, as shown.

According to the invention, the engine as described hereinabove furthermore includes a device 13 for supplying the combustion chamber 10 with air/fuel mixture. This device 13 comprises an air reservoir 14 communicating via a passage 15 with the casing 5 as well as via a port 16 with the cylinder 1, the port 16 lying substantially at the same height as the exhaust port 11. A venturi 17 is mounted in the chamber 13 at the location of the outlet of the latter towards the port 16, in the divergent cone of which venturi a fuel feed 18 connected to a constant-level tank, not shown, emerges. A rotary closure member 19 turning about an axis parallel to the axis of the cylinder 1 is mounted so that it can rotate inside the chamber 14 so as to control the communication between the interior of the chamber 14 and the cylinder 1. In the example represented, the closure member 19 is a slide valve closure member whose cylindrical wall located between the venturi 17 and the port 16 includes a window 21. The shaft 20 of the closure member 19 furthermore carries another rotary closure member 22 whose port 23 controls the communication between the chamber 14 and the casing 5 via the conduit 15, as well as a driving pinion 24 consisting of a bevel pinion engaging with a bevel pinion, not shown, of a shaft which is parallel to the crankshaft 7 and is driven by the latter.

It should be noted that, in the example represented, the introduction port 16 is arranged so that its lower edge is located at the height of the top of the piston 9 when the latter is at the bottom dead centre and its upper edge is located at a level slightly above the upper edge of the exhaust port 11. Furthermore, the introduction port 16 lies opposite the exhaust port 11 and the venturi 17 is oriented obliquely upwards towards the cylinder head 3 so as to produce a jet which crosses the axis of the cylinder 1 and passes above the exhaust port 11.

A description will be given hereinbelow of the mode of operation of the engine as described hereinabove.

Starting from the bottom dead centre position according to the drawing, the piston 9 moves towards the cylinder head 3 towards the top dead centre. During this upward travel of the piston, the volume of the casing 5 increases and air is sucked into the casing 5 through the inlet opening 6 and the valve, not shown.

When the piston 9 has reached the top dead centre, the spark plug 4 triggers combustion of the air/fuel mixture contained in the combustion chamber 10 and, under the thrust due to the gases resulting from this combustion, the piston 9 moves away from the cylinder head 3 towards the bottom dead centre. During this descent of the piston 9, the air previously sucked into the casing 5 is compressed, the valve, not shown, preventing any delivery of air through the inlet orifice 6.

During this descending movement, the piston 9 successively uncovers the introduction port 16, the exhaust port 11 and the transfer port 12. Since the introduction port 16 is still closed by the closure member 19, the exhaust gases are discharged through the exhaust port 11, this movement being assisted by the introduction, via the transfer orifice 12, of fresh air previously compressed in the casing 5.

Throughout this, although the introduction port 16 is uncovered by the piston 9, communication between the air reservoir 14 and the cylinder 1 remains interrupted by the slide valve 19.

It is only after the piston 9 has reached the bottom dead centre then started to move upwards towards the cylinder head 3 that the window 21 of the closure member 19 arrives in front of the introduction port 16 and thus establishes communication between the reservoir 14 and the cylinder 1. Under the pressure of the air in the reservoir 14, which pressure is greater than the pressure in the cylinder 1, the exhaust port 11 being not yet closed, air passes from the reservoir 14 through the venturi 17, carrying with it the fuel coming from the fuel feed 18, this flow of air and fuel being directed towards the top of the combustion chamber 10, above the exhaust port 11, so that the minimum amount of fuel reaches this port before it is closed by the piston 9.

After subsequent closure of the exhaust port 11, the window 21 and the port 16 still allow, for a brief instant, communication of the combustion chamber 10 with the reservoir 14, so that the pressure increasing in the combustion chamber 10 owing to the upward displacement of the piston 9 increases the pressure of the air contained in the reservoir 14, with a view to introduction of fuel during the following cycle.

The piston 9 then continues to move upwards towards the cylinder head 3, compressing the air/fuel mixture in the combustion chamber 10 and sucking air into the casing 5 through the inlet orifice 6 and the valve, not shown.

When the piston 9 reaches the top dead centre, the described steps of the cycle repeat in the same order.

It should be noted that the embodiment represented and described has been given only by way of illustrative and non-limiting example and that numerous amendments and variants are possible in the context of the invention.

Thus, introduction of pressurized air into the reservoir 14, instead of taking place by virtue of a system internal to the engine (transfer into the reservoir 14 of a part of the air compressed in the casing 5), could also take place by virtue of a system external to the engine.

Instead of locating the upper edge of the introduction port 16 above the upper edge of the exhaust port 11, it would also be possible to place the upper edges of these two ports at the same height, which would eliminate the increase in pressure of the air in the reservoir 14 when the piston 9 rises back up.

Furthermore, the closure member 19 could also be a rotary closure member other than in the form of a slide valve, turning about an axis other than parallel to the axis of the cylinder 1, although the arrangement described and represented is particularly favourable insofar as it makes it possible to place the closure member as close as possible to the introduction port 16 and to produce the introduction device 13 in its entirety in a particularly compact form.

I claim:

1. Air/fuel mixture supply device for a two-stroke internal-combustion engine of the type with scavenging by compressed air in the casing, the device comprising at least one cylinder, a piston capable of reciprocating motion in the cylinder for defining a combustion chamber and a scavenging-air compression casing provided with an air inlet orifice, the cylinder comprising at least one exhaust port, at least one transfer port communicating via a transfer duct with the casing, a port for introduction of an air/fuel mixture into the combustion chamber, towards the end of the scavenging, and a rotary closure member driven in synchronism with the rotation of the engine and associated with the port for introduction of the air/fuel mixture into the combustion chamber, the device further comprising an air reservoir supplied with air under a pressure greater than the pressure prevailing in the combustion chamber after opening of the exhaust port, a venturi placed between the reservoir and the rotary closure member, and a fuel feed coming from a constant-level tank and emerging in the divergent cone of the venturi.

2. Device according to claim 1, wherein the rotary closure member is placed inside the reservoir.

3. Device according to claim 2, wherein the rotary closure member is a cylindrical slide valve closure member whose axis is parallel to the axis of the cylinder and which includes in its cylindrical wall a window controlling the communication of the reservoir via the introduction port with the combustion chamber.

4. Device according to claim 1, wherein the air reservoir is supplied with pressurized air by a system external to the engine.

5. Device according to claim 1, wherein the air reservoir is supplied with pressurized air by a system internal to the engine.

6. Device according to claim 5, wherein the reservoir is supplied with pressurized air from the casing via a conduit controlled by a turning closure member driven in synchronism with the rotation of the engine.

7. Device according to claim 1, wherein the upper edge of the port for introduction of the air/fuel mixture into the combustion chamber lies at the same level as the upper edge of the exhaust port.

8. Device according to claim 1, wherein the upper edge of the port for introduction of the air/fuel mixture into the combustion chamber lies at a level closer to the cylinder head than the upper edge of the exhaust port.

9. Device according to claim 1, wherein the air/fuel jet of the air/fuel mixture supply device is directed towards the cylinder head so that the jet does not meet the exhaust port.

* * * * *